US005291670A

United States Patent [19]

Surra et al.

[11] Patent Number: 5,291,670

[45] Date of Patent: Mar. 8, 1994

[54] PROCESS FOR BAKING WIRE-LIKE PRODUCTS CLAD IN INSULATING PLASTICS RESIN, AND AN OVEN FOR PERFORMING THE SAID METHOD

[75] Inventors: Renato Surra, Rivoli; Bruno Bronzini, Moncalieri; Michele Ricco, Collegno, all of Italy

[73] Assignee: S.I.C.M.E. S.p.A. Societa Industriale Costruzioni Microelettriche, Torino, Italy

[21] Appl. No.: 754,362

[22] Filed: Aug. 29, 1991

Related U.S. Application Data

[63] Continuation of Ser. No. 454,765, Dec. 21, 1989, abandoned.

[30] Foreign Application Priority Data

Dec. 23, 1988 [IT] Italy ..... 68154 A/88

[51] Int. Cl.[5] ..... C23C 26/00

[52] U.S. Cl. ..... 34/155; 34/79; 34/156; 432/8; 432/59; 432/72; 427/120; 427/318; 427/378

[58] Field of Search ..... 427/120, 318, 379; 432/59, 8, 72; 34/79, 155, 156

[56] References Cited

U.S. PATENT DOCUMENTS

| | | | |
|---|---|---|---|
| 1,947,548 | 2/1934 | Fruth | 432/8 |
| 2,930,718 | 3/1960 | Abbott | 427/120 |
| 3,810,736 | 5/1974 | Dumas | 432/59 |
| 3,877,966 | 4/1975 | Goyffon | 427/318 |
| 3,903,327 | 9/1975 | Hajagos | 427/120 |
| 4,007,304 | 2/1977 | Dunn | 427/318 |
| 4,020,213 | 4/1977 | Berglowe | 427/318 |
| 4,448,578 | 5/1984 | Brumet | 432/59 |
| 4,475,294 | 10/1984 | Henricks | 34/79 |
| 4,497,849 | 2/1985 | Hughes | 427/120 |
| 4,591,336 | 5/1986 | Konczalski | 432/59 |
| 4,600,181 | 7/1986 | Falco | 34/155 |
| 4,752,217 | 6/1988 | Justus | 432/59 |
| 4,771,707 | 9/1988 | Robson | 432/72 |
| 4,856,986 | 8/1989 | Macocco | 432/59 |
| 4,938,689 | 7/1990 | Macocco | 432/59 |
| 4,999,166 | 3/1991 | Accati | 432/59 |

FOREIGN PATENT DOCUMENTS

| | | | |
|---|---|---|---|
| 355821 | 8/1931 | United Kingdom | 432/8 |
| 358342 | 10/1931 | United Kingdom | 427/120 |

*Primary Examiner*—Shrive Beck
*Assistant Examiner*—Vi Duong Dang
*Attorney, Agent, or Firm*—Gifford, Groh, Sprinkle, Patmore and Anderson

[57] ABSTRACT

A process for baking electrically conductive wires clad in insulating plastics resin, comprising a first, evaporation stage for evaporation of solvents and a second resin polymerization and cross-linking stage, which are performed respectively in a first and in a second region of a tunnel chamber in a continuous oven between the inlet regions and outlet regions of which the wires advance, a third stage comprising aspiration from the oven of a mixture of air and solvents formed during the first evaporation stage, and a fourth stage comprising heating this mixture to a predetermined temperature such as to cause combustion of the solvents, and including a fifth stage of introducing heat energy to these regions of the oven from at least part of the stream of air and combustion products coming from the fourth stage, through heat exchangers disposed on the outer surface of this tunnel chamber, in such a way as significantly to reduce the introduction of heat energy provided to the chamber by heating means supplied externally of the oven.

5 Claims, 5 Drawing Sheets

PROCESS FOR BAKING WIRE-LIKE PRODUCTS CLAD IN INSULATING PLASTICS RESIN, AND AN OVEN FOR PERFORMING THE SAID METHOD

This is a continuation of copending application Ser. No. 07/454,765 filed on Dec. 21, 1989, now abandoned.

BACKGROUND OF THE INVENTION

The present invention relates to a method for baking wire-like products, and in particular copper wires enamelled with a cladding of insulating plastics resin.

As is known, processes currently used for baking the cladding of electrically conductive wires comprise two stages successively performed in respective first and second regions of an oven, usually of the continuous or tunnel type. During the first stage of the process the solvents which impregnate the layer of synthetic resin cladding the wire are caused to evaporate by heating, while during the second stage of the process the wire is heated to a temperature greater than that of the first stage so as to cause polymerization and cross-linking of the cladding resin, which has insulating properties. During these stages the wire is advanced through the tunnel oven, parallel to the longitudinal axis of this oven, at a predetermined speed. The heating of the oven is usually effected by electrical or gas radiant elements disposed within the oven itself. The evaporated solvent mixes with the air present in the oven which therefore becomes polluted; before discharge, therefore, the stream of air and solvent is subject to a combustion process, conveniently by means of an armored electrical resistance heater unit followed by catalytic plates, which cuts out the major part of the solvent by oxidizing it into non-polluting products such as steam and carbon dioxide.

The known process described above is not entirely free from disadvantages in that, as well as periodically extracting a part of the atmosphere from the furnace and replacing it with fresh air, which is also undertaken for reasons tied to the control of the constancy of the desired temperature in the oven, this involves a rather significant amount of loss of the heat accumulated in the airstream sent to the discharge since the said combustion heater unit is operated at a temperature considerably greater than that of the oven.

Ovens have therefore been made in which a part of the heat in the discharge flow is recovered, in that at least a part of this flow is reintroduced into the oven chamber, for example close to the inlet opening or the outlet opening or both, so as to effect heating of the oven chamber also by convection. This process is not however suitable for the baking of wire-like products of relatively small diameter, less than 0.2 mm, since the direct movement of the air on the wire detrimentally affects the achievement of uniformity in the final characteristics of the wire.

SUMMARY OF THE INVENTION

The object of the present invention is that of providing a process for baking wire-like products clad in insulating plastics resin, which overcomes the above-indicated disadvantages, that is allows a significant amount of heat from the combustion heater unit to be recovered without in any way endangering the characteristics of the wire-like product obtained at the output of the oven, particularly for wire-like products of relatively small diameter.

Other objects and advantages obtained with the process of the present invention will become apparent from the following description.

According to the present invention there is provided a process for baking wire-like products clad in plastics resin, comprising a first, evaporation stage for evaporating at least one solvent from the said resin and a second, resin polymerization and cross-linking stage, the said first and second stages being performed respectively in a first and a second region of a tunnel chamber in a continuous oven, between the inlet and outlet regions of which the said products advance, and including a third stage comprising aspiration from the said oven of a mixture of air and the said solvent formed during the said first, evaporation stage, and a fourth stage comprising heating the said mixture to a predetermined temperature such as to achieve combustion of the said solvent, characterised by the fact that it includes a fifth stage comprising introduction of heat energy to at least one of the said regions of the oven from at least part of the stream of air and combustion products coming from the said fourth stage, through a heat exchange surface with the said region, in such a way as significantly to reduce the introduction of heat energy provided to the said region by heating means fed from outside the oven.

BRIEF DESCRIPTION OF THE DRAWINGS

For a better understanding of the process of the present invention a particular embodiment of oven putting the said process into practice is now described purely by way of non-limitative example with reference to the attached drawings, in which.

DETAILED DESCRIPTION OF THE INVENTION

Figure 1:
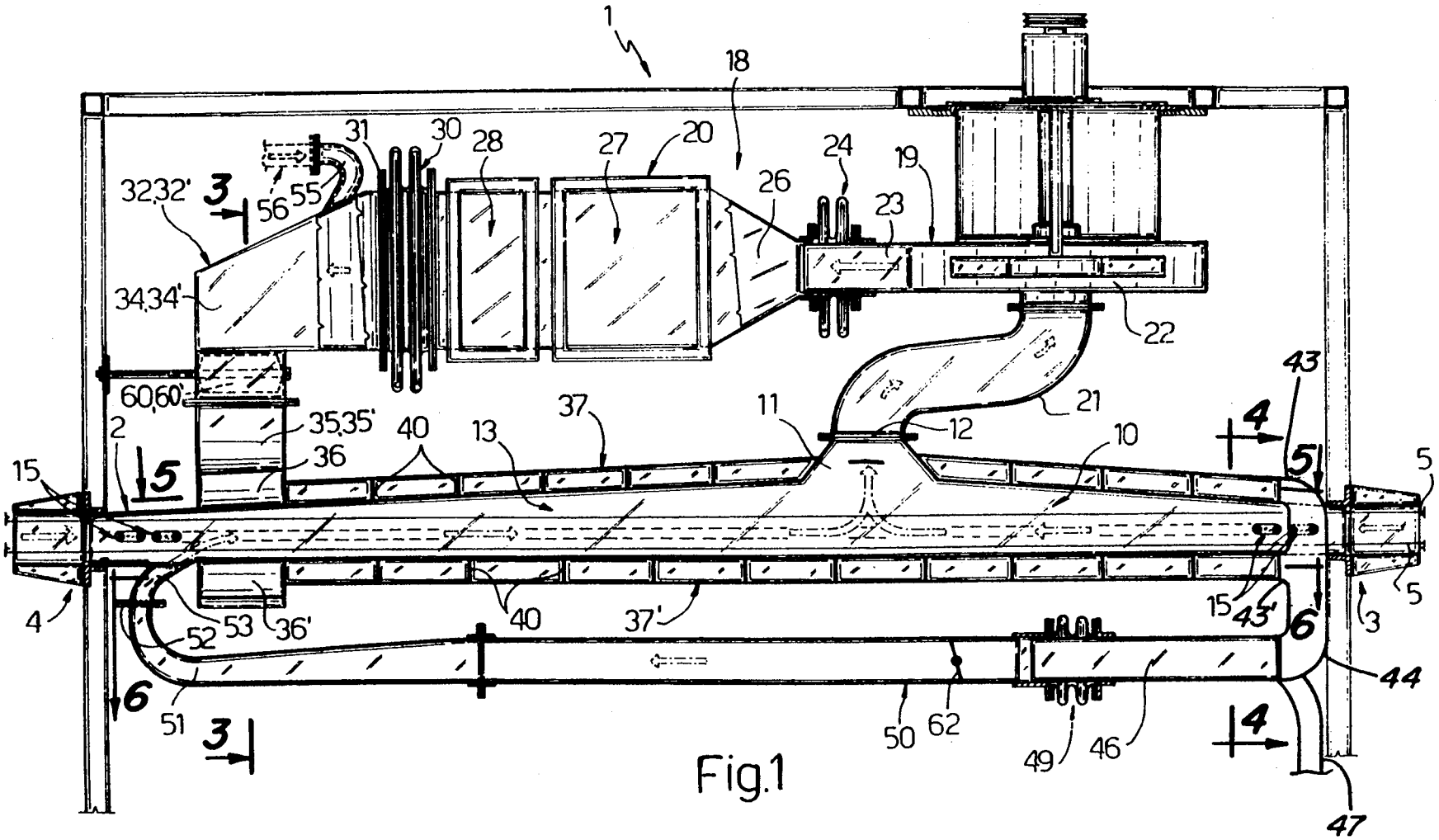
FIG. 1 is a section side view of a wire-like product baking oven formed according to the principles of the present invention.
Figure 2:
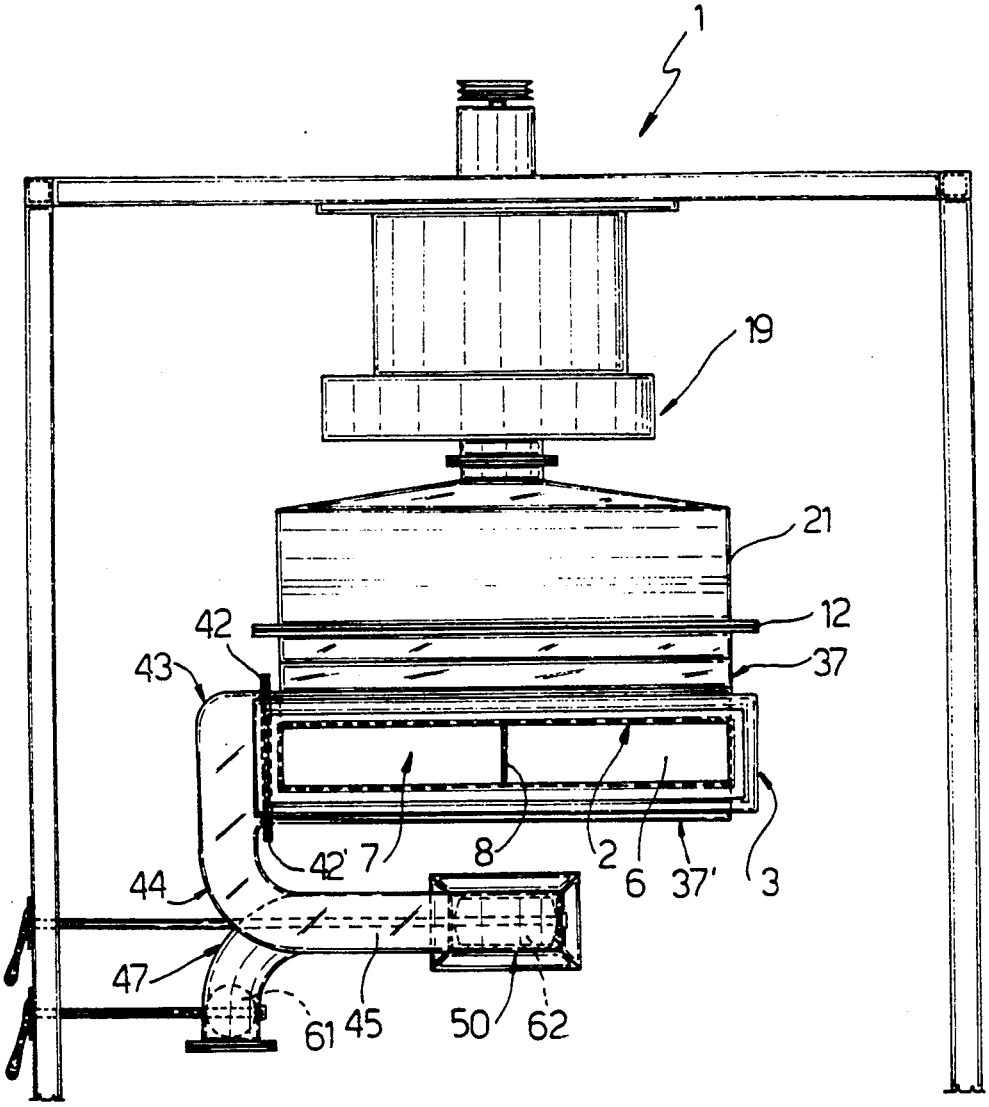
FIG. 2 is a front view of the oven of FIG. 1.
Figure 3:
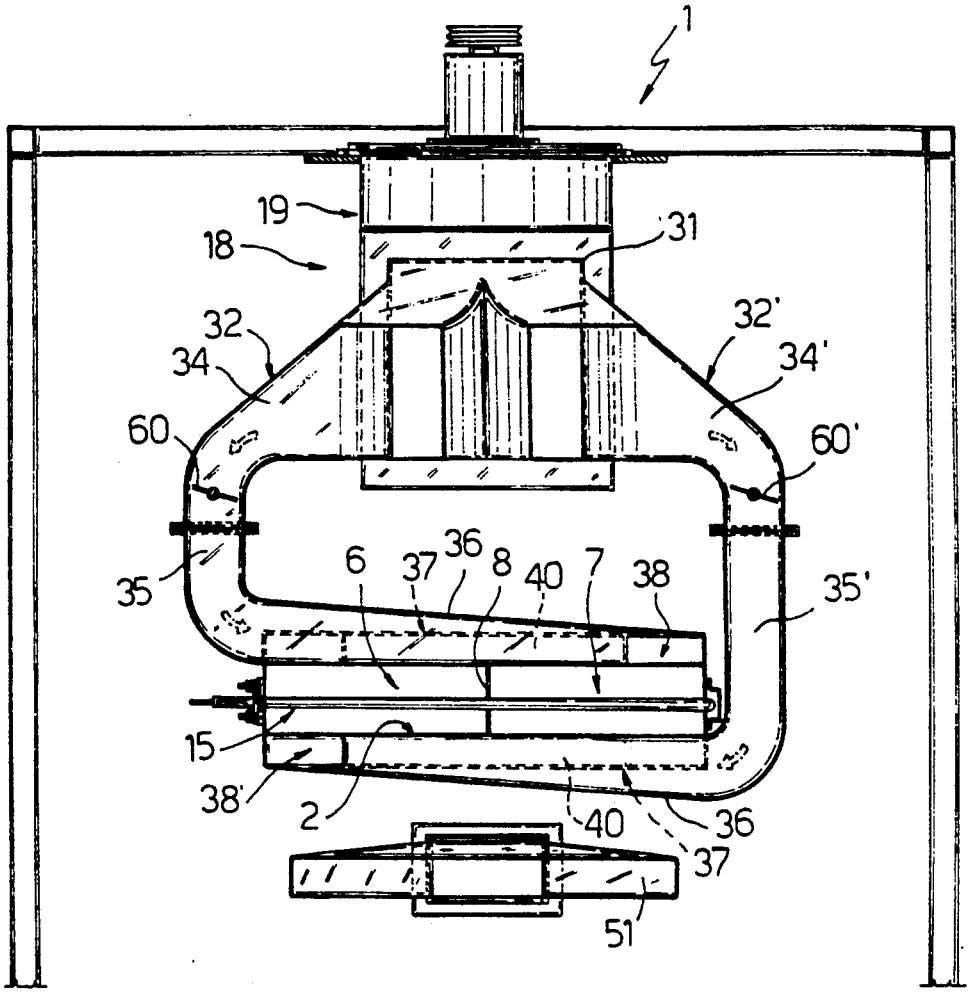
FIGS. 3, 4, 5 and 6 are sectioned views taken on the lines III—III, IV—IV, V—V and VI—VI respectively of the oven of FIG. 1.
Figure 4:
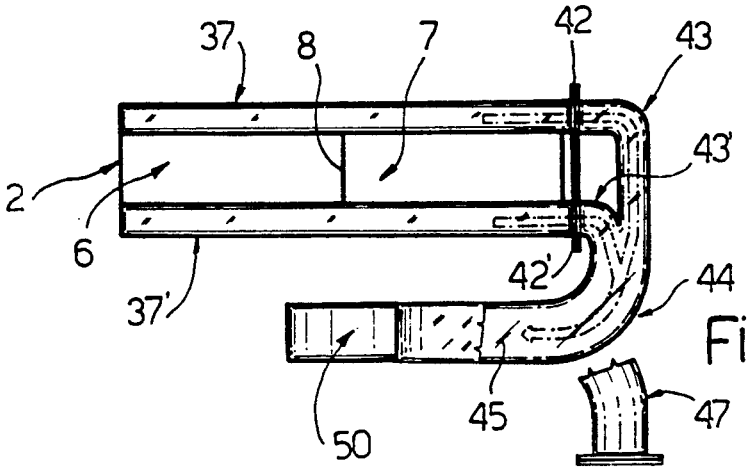

With reference to FIG. 1, an oven for baking the insulating plastics resin covering of electrically conductive or copper wires 5 is generally indicated with the reference numeral 1 and comprises, in a known way, a horizontal tunnel chamber 2 provided with an inlet opening 3 and an outlet opening 4, within which a plurality of such wires 5 advance longitudinally in a continuous manner. At these openings 3 and 4 are located shutter devices of known type for regulating the quantity of external air which is drawn into the chamber 2, which latter has a substantially rectangular cross-section (FIGS. 2, 3 and 4) with its longer sides horizontal, and is divided into two parallel ducts 6 and 7 by a wall 8 located longitudinally within the chamber 2 and parallel to the vertical smaller sides. This chamber 2 has a first portion 10 which starts from the inlet opening 3 and continues with a progressively increasing cross-section up to a region 11 where there is located an upper opening 12 of the tunnel chamber 2, and further has a second portion 13 which starts from this region 11 and continues, with progressively decreasing cross-section, to the outlet opening 4. In this chamber 2, parallel to the larger sides, there are disposed armored electrical resistors 15 (FIG. 3) the supply connection terminals of which project externally of the chamber 2 itself. Thermocouples (known and not shown) housed in the various regions of the chamber 2 control the constancy of the desired temperature by regulation of the electrical supply to the resistors 15, and conveniently, also by regulation of other parts of the oven 1 as will be described hereinbelow.

Disposed alongside and above the tunnel chamber 2 there is an auxiliary unit 18 which comprises a fan unit 19 of relatively high capacity, followed by a heater unit 20. In particular, to the outlet opening 12 towards the central region of the chamber 2 there is connected a shaped duct 21 which opens into the inner chamber 22 of the fan unit 19, conveniently of the centrifugal blade type, the outlet opening 23 from which is connected, by means of a bellows-type connection coupling 24 to allow relative axial displacement between the communicating duct parts, with an inlet opening 26 of the unit 20, which comprises in succession, in a known way, an electrical resistor heater unit 27 and a catalytic plate combustion chamber 28.

The outlet from this chamber 28 is connected, by means of a bellows-type connection coupling 30, to an opening 31 from which extend two ducts 32 and 32' which each have a first horizontal section 34 and 34' facing towards the outlet opening 4 of the oven 1, a decreasing cross-section, and an inclination towards the outside of the smaller side walls of the chamber 2 (FIG. 3), with downwardly facing ends to which are connected respective second vertical sections 35 and 35' which terminate in correspondence with the upper and lower regions of the chamber 2 respectively. In particular, these sections 35 and 35' terminate with respective sections 36 and 36' inclined to the horizontal and contained in a plane perpendicular to the axis of the chamber 2 in correspondence with the inlet openings 38 and 38' of heat exchangers 37 and 37' respectively mounted on the upper wall and the lower wall delimiting the tunnel chamber 2.

Figure 5:
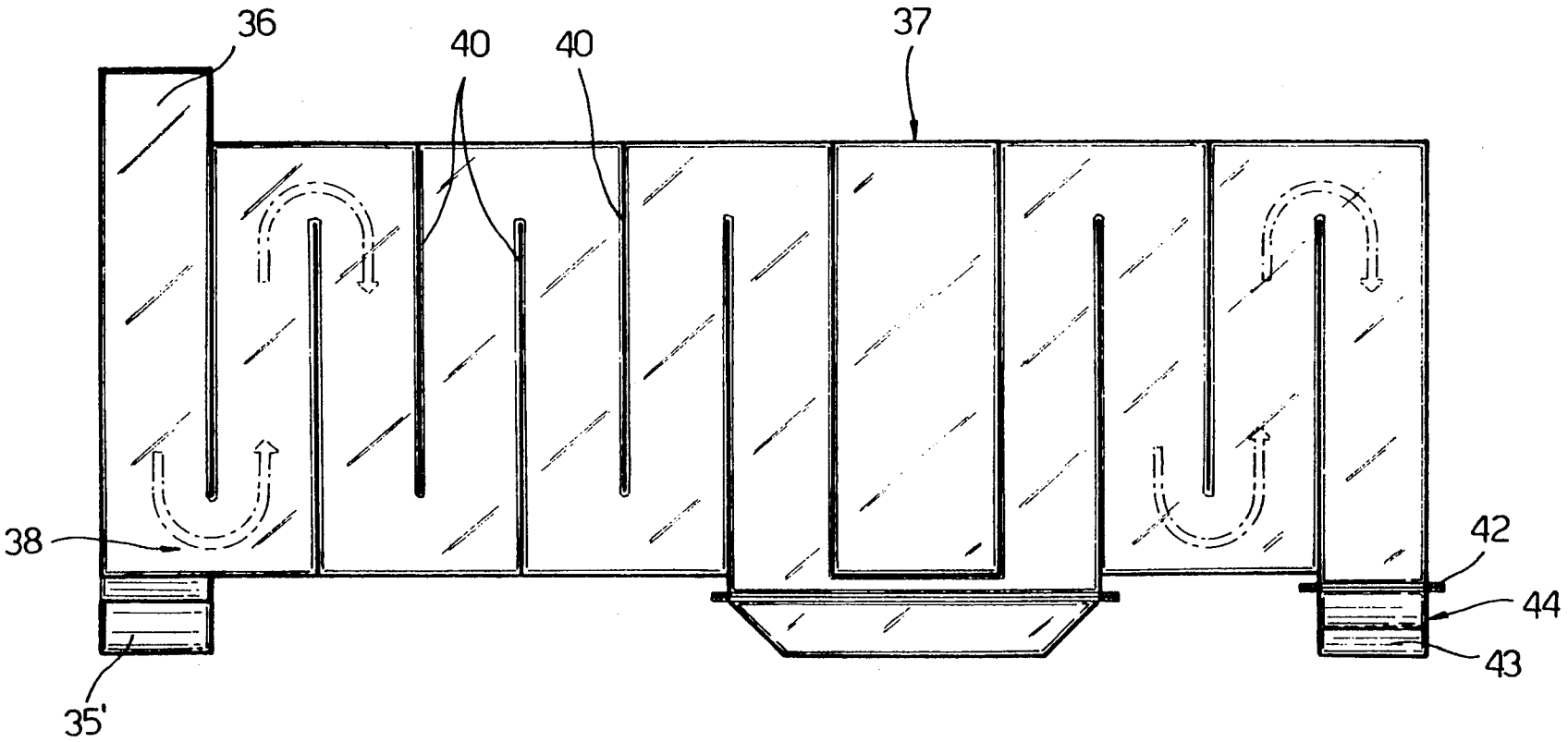

These heat exchangers 37 and 37' (which can be seen in FIGS. 5 and 6) have a substantially rectangular cross-section with the same width as the chamber 2 and with a height equal to about half that of the chamber 2, and a length almost corresponding to that between the openings 3 and 4 at the ends of the oven 1. They are made with portions of sheet metal which constitute the two side walls and the outer wall, while the inner wall is constituted by the upper or lower wall of the chamber 2 itself, and moreover have internal vertical walls 40, of length less than that of the width of the heat exchanger itself, and of the same height, disposed offset with respect to one another, that is starting alternately from the two opposite side walls of the heat exchanger so as to constitute a labyrinthine path for the stream, as is indicated in broken outline.

Figure 6:
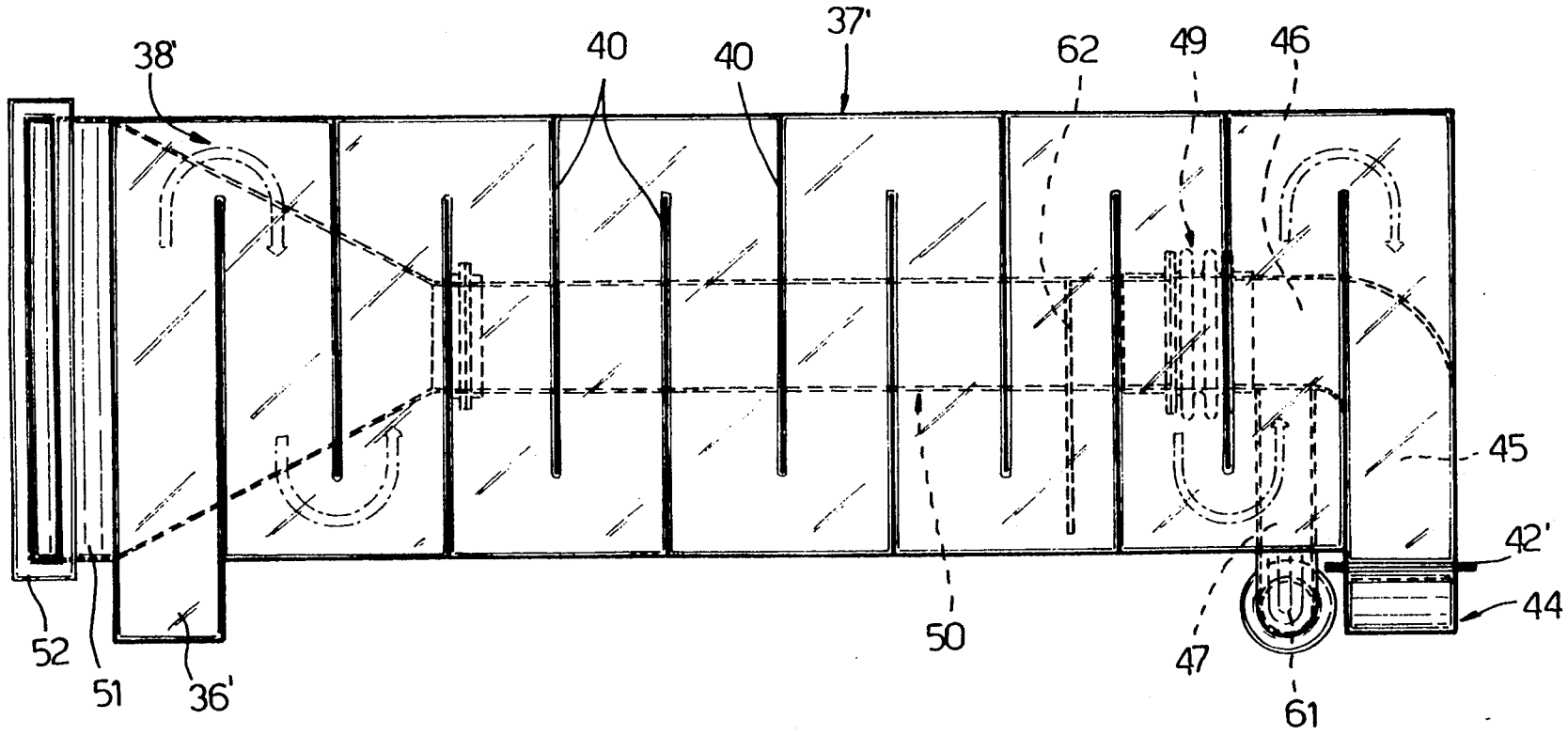

In the terminal portion these heat exchangers 37 and 37' have respective outlet openings 42 and 42' (visible in FIG. 4) to which are connected two respective ducts 43 and 43' which have a first horizontal portion and then a subsequent vertical portion, and then join a single duct 44 which has a first portion 45 bent horizontally towards the central region underlying the tunnel chamber 2 (FIGS. 2 and 4), and then a second portion 46 bent in a direction parallel to the axis of the oven 1 towards the outlet opening 4 (FIGS. 1 and 6). From this portion 46 extends a duct 47 bent downwardly to provide communication with a discharge chimney (not illustrated). The end of the portion 46 is connected, by means of a bellows-type connection coupling 49, with the start of the duct 50 disposed parallel to the axis of the oven 1 and beneath the tunnel chamber 2, which has a terminal portion 51 of progressively increasing cross-section (visible in broken outline in FIG. 6) rising to the same width as the chamber 2 and curving upwardly in such a way as to connect with an opening 52 of a short curved section 53 which opens into a lower region of the chamber 2 towards the outlet opening 4.

A pair of short curved portions 55 (FIG. 1) open into the initial portions 34 and 34' of the ducts 32 and 32', and connect these to a duct 56 (indicated in broken outline) for withdrawing fresh air from the outside.

Respective flow control valves 60 and 60' are disposed in these portions 34 and 34', and other valves 61 and 62 are disposed in the duct 47 and in the duct 50 respectively. The process according to the present invention, achieved by operation of the oven 1 as described, is as follows.

The wire 5 enters into the tunnel chamber 2 through the inlet opening 3 and passes through the first region 10, maintained at a temperature lying between 150° C. and 350° C., in which evaporation of the solvents of the resin which constitute its cladding take place; it then passes into the second portion 13, maintained at a temperature lying between 400° C. and 550° C., in which polymerization and cross-linking of the resin occurs.

The fan unit 19 draws from the opening 12 in the chamber 2 a stream substantially constituted by a mixture of air and solvent vapors. This aspirated stream, which has a temperature of about 450° C. is then sent to the electrical resistor unit 27 which raises it to a temperature of about 700°-750° C. sufficient to trigger combustion of the said vapors, and then the catalytic plate combustion chamber 28 facilitates the complete oxidation of these vapors into innocuous combustion products.

According to the process of the present invention, this high temperature stream at the output of the combustion unit 20 is possibly mixed with fresh air at a lower temperature, coming from the duct 56 in adjustable quantities, and is sent to the heat exchangers 37 and 37' being divided between these by means of the valves 60 and 60'. In this way, with this stream flowing through the heat exchangers 37 and 37' for the whole of their length, a substantial quantity of heat is yielded up to the chamber 2, conveniently equal to at least one third of the introduced heat energy provided by the electrical heaters 15. This quantity of heat is provided in a balanced manner for each section of the chamber 2 in that the heat exchangers 37 and 37' are in contact with the extended upper and lower outer surfaces of the chamber 2, and this heat flow takes place over the whole of the regions 10 and 13 of the oven 1.

At the output of the heat exchangers 37 and 37' there is therefore a stream of air and combustion products at a, by now, relatively low temperature, which flows into the duct 44 from which it can be in part delivered to the discharge chimney through the duct 47 and the regulation valve 61, and in part delivered into the chamber 2 via the recirculation duct 50 and the regulation valve 62; in particular, the introduction of this stream into the chamber 2 takes place through the terminal part of the region 13 close to the outlet opening 4 with a relatively low velocity in that the terminal sections 51 and 53 of the duct 50 have a significant progressive increase in cross-section, and in a counter-current direction towards the center of the region 13 and tangentially towards the axis of the chamber 2, caused by the curved configuration the section 53 which opens into the chamber 2, so as to avoid damaging effects of the air motion on the wires 5, which can have very small diameters.

The regulation of the quantity of heat yielded by the heat exchangers 37 and 37′ to the chamber 2, and its proportion with that provided directly by the electrical heater elements 15, can be monitored and controlled automatically by means of automatic regulation of at least the valves 60, 60′, 61 and 62, and the rate of flow of the fan unit 19, through temperature detection systems based on thermocouples positioned at various points within the oven 1.

The advantages of the process and the oven formed according to the present invention are evident from what has been described. In particular, the heat energy from the outlet stream from the combustion unit 20 is recovered in an almost complete manner to the advantage of the heat energy which must otherwise be provided to the chamber 2 of the oven by means of externally supplied elements, for example the electrical resistors 15, and this recovery of heat is very significant in that it can be equal to at least one third of the heat energy provided by the elements 15. The delivery of heat energy to the chamber 2 is effected in a manner which does not alter the desired internal conditions within the chamber 2 itself, in relation to the distribution of the progressive temperature variations along the regions 10 and 13, in relation to the distribution of the temperature in each individual region, and in relation to the speed of the airstream within the chamber 2 so as to be able to utilize the oven 1 in optimum conditions even for wires 5 of relatively small diameter, that is less than 0.2 mm and in particular between 0.15 and 0.5 mm. This is achieved thanks to the fact that this introduction of heat energy to the chamber 2 is achieved principally by means of the external heat exchangers 37 and 37′, and only in a reduced measure by means of convection through a final portion of the stream at by now relatively low temperatures introduced in counter-current in the terminal region of the chamber 2 near the outlet opening 4, and the heat exchangers 37 and 37′ are fitted substantially along the whole of the length of the chamber 2 and around it.

Finally, it is clear that both to the process of the present invention and to the embodiment of oven described and illustrated there can be introduced modifications and variations which do not depart from the ambit of the inventive idea contained in it. For example, the heat exchangers 37 and 37′ can have a different shape, and the oven 1 can have a different arrangement for connection of the various ducts.

We claim:

1. An oven for baking wire products coated with a plastic resin, comprising:

a principal chamber of elongate form within which said products translate axially in a longitudinal direction between an inlet opening and an outlet opening, said principal chamber defining a first heating portion in which evaporation of the solvents from said plastic resin occurs and a second heating portion in which polymerization and cross-linking of said plastic resin occurs;

principal heating means external to said principal chamber for heating said principal chamber;

an auxiliary unit comprising an aspiration opening communicating with said principal chamber;

aspiration means for aspirating a stream of air and solvent vapors from said principal chamber and means for heating said stream of air and solvent vapors to cause a stream of combusted air and solvent vapors; and characterized by the fact that said oven includes at least one heat exchanger, said at least one heat exchanger receiving said stream of combusted air and solvent vapors from said auxiliary unit, said at least one heat exchanger extending substantially between said inlet opening and said outlet opening of said principal chamber, said aspiration opening extending through said at least one heat exchanger so as to aspirate said stream of pre-combusted air and solvent vapors from said principal chamber, said at least one heat exchanger transferring the heat energy derived from said combusted air and solvent vapors back into said first and second heating portions of said oven without causing said combusted air and solvent vapors to be introduced into said oven, said heat energy being introduced in significant quantities with respect to that provided by said principal heating means supplied externally of said oven, whereby the heat energy transferred to said first and second heating portions assists in the evaporation of the solvents from said plastic resin and the polymerization and cross-linking of said plastic resin.

2. The oven according to claim 1, wherein said at least one heat exchanger comprises a pair of structures mounted on opposite sides of an outer surface of said principal chamber of said oven, said structures each forming internally a respective labryinthine path extending from said outlet opening and toward said inlet opening of said principal chamber.

3. The oven according to claim 1, further comprising an aperture in said principal chamber near said outlet opening, said aperture being connected with a recirculation duct, said recirculation duct withdrawing at least part of said stream of combusted air and solvent vapors from said at least one heat exchanger, said at least part of said stream of combusted air and solvent vapors being reintroduced into said principal chamber through said aperture.

4. The oven according to claim 1, wherein said aspiration means for aspirating a stream of air and solvent vapors from said principal chamber comprises a fan, said fan being of a centrifugal blade type.

5. The oven according to claim 1, wherein said means for heating said stream of air and solvent vapors to cause combustion comprises an electrical resistor heater unit and a catalytic plate combustion chamber.

* * * * *